US006228545B1

(12) United States Patent
Fujii et al.

(10) Patent No.: US 6,228,545 B1
(45) **Date of Patent: *May 8, 2001**

(54) ELECTROPHOTOGRAPHIC SELENIUM PHOTOCONDUCTOR

(75) Inventors: Makoto Fujii; Hideki Kina, both of Nagano (JP)

(73) Assignee: Fuji Electric Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,582

(22) Filed: Jun. 3, 1999

(30) Foreign Application Priority Data

Jun. 11, 1998 (JP) ..... 10-163956

(51) Int. Cl.[7] ..... G03G 5/082

(52) U.S. Cl. ..... 430/58.1; 430/85; 430/95

(58) Field of Search ..... 430/84, 85, 95, 430/58.5, 58.1

(56) References Cited

U.S. PATENT DOCUMENTS

| | | | |
|---|---|---|---|
| 3,861,913 | 1/1975 | Chiou | 430/58.5 |
| 4,822,712 | 4/1989 | Foley et al. | 430/128 |
| 4,920,025 | 4/1990 | Sweatman et al. | 430/128 |
| 5,035,857 | 7/1991 | Kowalczyk et al. | 430/128 |

FOREIGN PATENT DOCUMENTS

| | | |
|---|---|---|
| 60-237455 | 11/1985 | (JP) . |
| 62-237455 | 11/1987 | (JP) . |
| 64-28653 | 1/1989 | (JP) . |
| 2-282265 | 11/1990 | (JP) . |

*Primary Examiner*—John Goodrow
(74) *Attorney, Agent, or Firm*—Morrison Law Firm

(57) ABSTRACT

A selenium photoconductor has a charge transport layer and a charge generation layer formed on a conductive substrate. Both the charge generation layer and the charge transport layer are made from a selenium-arsenic alloy, with the charge generation layer having a concentration of arsenic greater than the concentration of arsenic in the charge transport layer. This concentration distribution results in a photoconductor having excellent charge-generation efficiency and mobility. In an alternate embodiment, a halogen is doped into the charge generation layer and charge transport layer. The resulting photoconductor is useful in large-scale, high speed printing operations.

8 Claims, 5 Drawing Sheets

ELECTROPHOTOGRAPHIC SELENIUM PHOTOCONDUCTOR

BACKGROUND OF THE INVENTION

The present invention relates to an electrophotographic photoconductor. More specifically, the present invention relates to an electrophotographic photoconductor for use in a laser printer or a plain paper copier. Even more specifically, the present invention relates to an electrophotographic selenium photoconductor (more simply referred to as a "photoconductor") comprising a photosensitive film formed by vacuum-depositing a selenium-arsenic alloy onto a conductive substrate.

Selenium photoconductors, often used as electrophotographic photoconductors, are manufactured by vacuum-depositing a selenium film onto an outer surface of a conductive substrate of an aluminum alloy. In, for example, laser printers or plain paper copiers, the outer surface of the conductive substrate is cylindrical in shape. Selenium-arsenic photoconductors, also formed by vacuum-depositing a selenium-arsenic alloy onto a conductive substrate, are used predominantly as a single-layered photosensitive film.

When mounted in, for example, a large-scale, high-speed printer capable of printing about 40 to 150 A-4-sized sheets per minute, a conventional single-layered selenium-arsenic photoconductor provides sufficient photo response. However, with printers capable of printing 300 or more sheets per minute, the single-layered film structure provides insufficient photo response due to small light exposure impinging on the surface of the photoconductor. This insufficient exposure deteriorates image quality when printing at such high speeds.

In addition, due to large variations in sensitivity depending on the wavelength of the light source, the single-layered selenium photoconductor does not enable free selection of the wavelength of the light source for a printer using the single-layered selenium photoconductor. Therefore, the conventional photoconductor-mounting machine is usually responsible for reducing the variation of the wavelength of the light source.

OBJECTS AND SUMMARY OF THE INVENTION

It is an object of the present invention to provide an electrophotographic selenium photoconductor which overcomes the foregoing problems.

It is a further object of the present invention to provide an electrophotographic selenium photoconductor which provides sufficient photo response despite the small light exposure impinging on the surface of the photoconductor.

It is another object of the present invention to provide an electrophotographic selenium photoconductor which enables a light source available for a photoconductor-mounting machine to be selected from a larger number of candidates to maintain more constant sensitivity despite variations of the wavelength of the light source.

Briefly stated, the present invention provides a selenium photoconductor having a charge transport layer and a charge generation layer formed on a conductive substrate. Both the charge generation layer and the charge transport layer are made from a selenium-arsenic alloy, with the charge generation layer having a concentration of arsenic greater than the concentration of arsenic in the charge transport layer. This concentration distribution results in a photoconductor having excellent charge-generation efficiency and mobility.

In an alternate embodiment, a halogen is doped into the charge generation layer and charge transport layer. The resulting photoconductor is useful in large-scale, high speed printing operations.

According to an embodiment of the present invention, there is provided an electrophotographic selenium photoconductor comprising: a conductive substrate; a charge transport layer on the conductive substrate; a charge generation layer on the charge transport layer; the charge generation layer having a first arsenic concentration; the charge transport layer having a second arsenic concentration the charge generation layer and the charge transport layer are formed by vacuum-deposition of a selenium-arsenic alloy; the first arsenic concentration being greater than the second arsenic concentration; the first arsenic concentration is between about 30 and 50 weight percent; and the second arsenic concentration is between about 20 and 40 weight percent.

According to a further embodiment of the present invention, there is provided a photosensitive film for electrophotographic, comprising: a charge transport layer; a charge generation layer on the charge transport layer; the charge generation layer having a first arsenic concentration; the charge transport layer having a second arsenic concentration; the charge generation layer and the charge transport layer are formed by vacuum-deposition of a selenium-arsenic alloy; the first arsenic concentration is between about 30 and 50 weight percent; the second arsenic concentration is between about 20 and 40 weight percent; and the first arsenic concentration being greater than the second arsenic concentration, whereby a photo response is generated upon light impinging on a surface of the photosensitive film.

To achieve the above objectives, there is provided a selenium photoconductor comprising two types of vacuum-deposited selenium-arsenic alloy layers having different arsenic concentrations. The first type functioning in charge-generation. The second type functioning in charge-transportation. The inventors have found the configuration and conditions for both selenium-arsenic alloy layers to improve charge-generation efficiency and mobility of the photosensitive film.

The present invention relates to a electrophotographic selenium photoconductor comprising a conductive substrate and a photosensitive film on the conductive substrate. The photosensitive film includes a charge generation layer and a charge transport layer made by vacuum-depositing two types of selenium-arsenic alloys having different arsenic concentrations. The charge generation layer is formed from a selenium-arsenic alloy having a higher arsenic concentration. The charge transport layer is formed from a selenium-arsenic alloy with a lower arsenic concentration.

This configuration endows the electrophotographic selenium photoconductor with a greatly enhanced sensitivity. The increased sensitivity of the electrophotographic selenium photoconductor allows for the generation of an adequate photo response during large-scale and high-speed printing. Moreover, the enhanced sensitivity of the selenium photoconductor remains constant with varying light source wavelengths.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
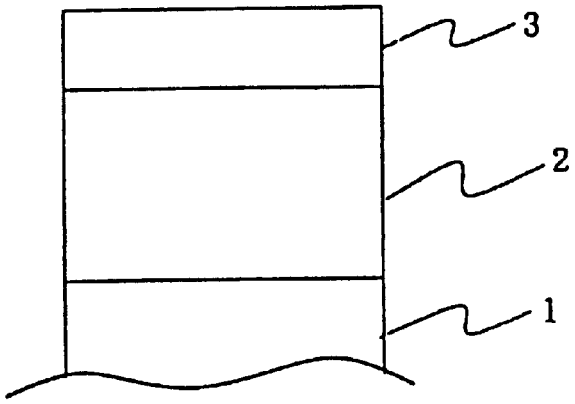
FIG. 1 is a typical cross-sectional view of a laminated photoconductor.

Referring, to FIG. 1, a charge transport layer 2 is formed on a conductive substrate 1. A charge generation layer 3 is formed on the charge transport layer. Preferably, charge generation layer 3 is laminated on the charge transport layer 2. A protective layer (not shown in the figure) may be formed, preferably by lamination, on charge generation layer 3 as required.

Conductive substrate 1 is preferably shaped as a cylinder, a plate, or a film.

Conductive substrate 1 can be made of metals, such as aluminum, iron, copper, stainless steel, nickel, or their alloys. Alternatively, glass or synthetic resin, having a surface treated to permit conductivity, can be used as conductive substrate 1.

A relatively large thickness of selenium-arsenic alloy is vacuum-deposited on conductive substrate 1 to form charge transport layer 2. The vacuum-deposition is performed by any of the conventional techniques, preferably a resistance-heating deposition method, in which material filled in an evaporation source is heated to evaporate the material in a vacuum. A charge generation layer of a small thickness is preferably formed using a flash deposition method, or, in the alternative, the conventional resistance heating deposition method.

The present invention uses two types of selenium-arsenic alloys with different arsenic concentrations. The selenium-arsenic alloy with a higher arsenic concentration forms charge generation layer 3, while the selenium-arsenic alloy with a lower arsenic concentration forms charge transport layer 2. This configuration is used for the reasons that follow.

As shown in the following examples, when the arsenic concentration of charge transport layer 2 was gradually reduced while maintaining a constant arsenic concentration in the deposited selenium-arsenic alloy of charge generation layer 3, the mobility was confirmed to increase. On the other hand, when the arsenic concentration of charge generation layer 3 was gradually increased while maintaining a constant arsenic concentration of charge transport layer 2, the charge mobility and charge-generation efficiency were both confirmed to increase. Preferably, the arsenic concentration of charge generation layer 3 is higher than that of charge transport layer 2. More preferably, the arsenic concentration of charge generation layer 3 is more than 2 wt. % higher than the arsenic concentration of charge transport layer 2.

The arsenic concentration in the selenium-arsenic alloy of charge generation layer 3 is preferably between 30 and 50 wt. %, while the arsenic concentration in the selenium-arsenic alloy of charge transport layer 2 is preferably between 20 and 40 wt. %. When the arsenic concentration of charge generation layer 3 is less than 30 wt. %, insufficient charges are generated. When the arsenic concentration of charge generation layer 3 is above 50 wt. %, defects in appearance occur. In addition, when the arsenic concentration in the selenium-arsenic alloy of charge transport layer 2 is less than 20 wt. %, defects in appearance (cracks) occur because of the difference in expansion coefficient between the selenium-arsenic alloys in the charge-generation and charge transport layers. When the arsenic concentration in the selenium-arsenic alloy of charge transport layer 2 rises above 40 wt. %, the charge mobility becomes insufficient.

According to the photoconductor of the present invention, the concentration of halogen to be doped in the photosensitive film is preferably between 500 and 10,000 ppm. If the concentration of halogen doped in the photosensitive film is less than 500 ppm, sufficient mobility cannot be obtained. If the concentration of halogen doped in the photosensitive film is beyond 10,000 ppm, the decay rate in darkness increases (the retention of charged electrical potential decreases).

Charge generation layer 3 has a thickness preferably between about 5 and 20 $\mu$m for effective charge generation. Charge transport layer 2 has a thickness preferably between about 20 and 60 $\mu$m in order to adequately transport charges injected from charge generation layer 3 during light reception. In addition, this preferred thickness allows charge transport layer 2 to act as an insulator layer in darkness, by retaining charges accumulated in the photosensitive layer. The thickness of the entire laminated photosensitive film is therefore be between about 25 and 80 $\mu$m.

EXAMPLES

The present invention is described based on the following examples. The "%" indicated below means "wt. %".

Relationship Between the Arsenic Concentration of the Charge Generation Layer and the Charge Mobility The relationship between the arsenic concentration of charge generation layer 3 and charge mobility was determined for laminated photoconductors formed by using a resistance heating deposition method to vacuum-deposit selenium-arsenic alloys on each of the cylindrical aluminum substrates. The arsenic concentration of charge generation layer 3 is varied, while the arsenic concentration of charge transport layer 2 was fixed at 30 wt. %

Figure 3:
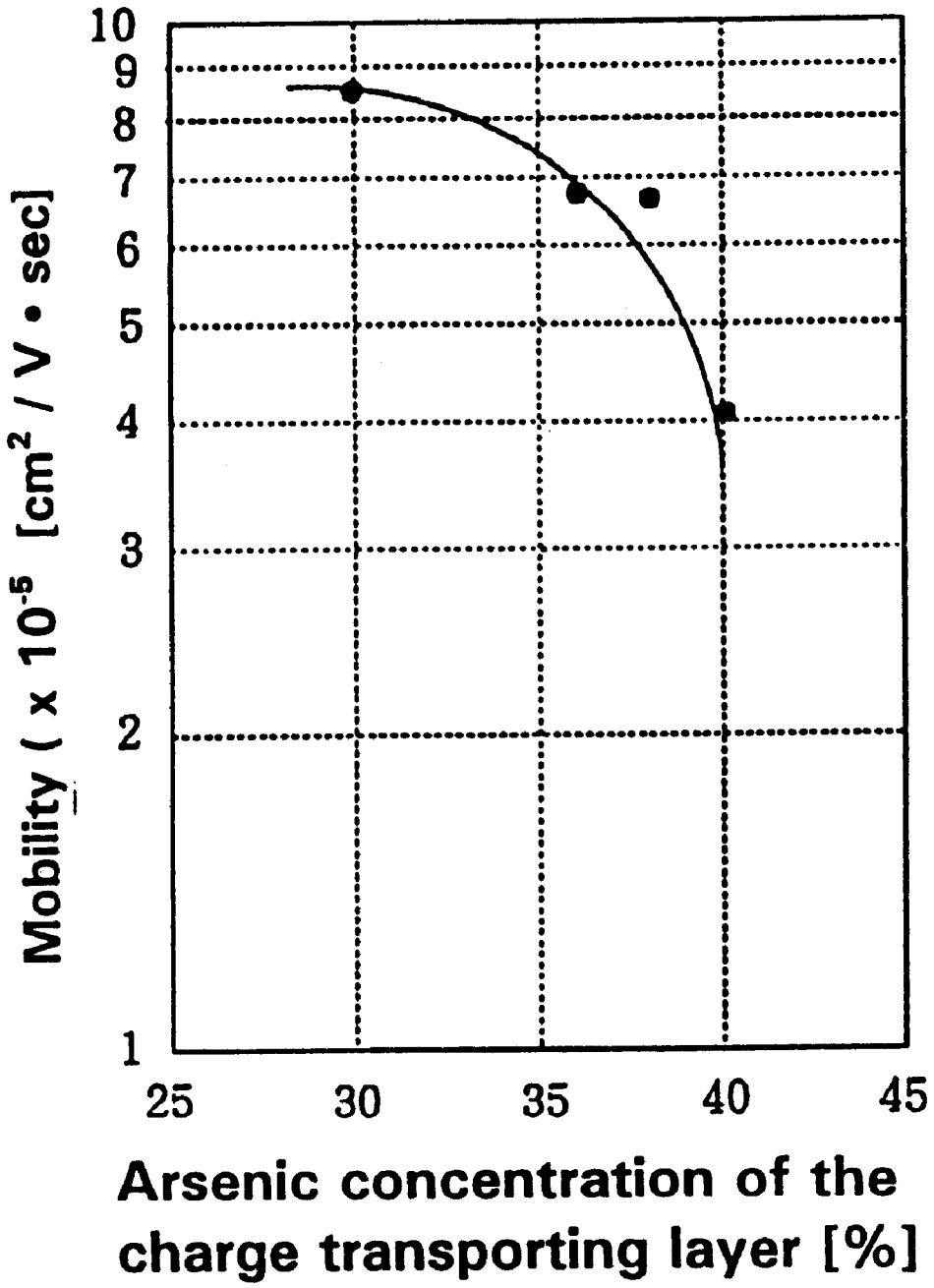
FIG. 3 is a graph showing relationship between arsenic concentration in the charge transport layer and charge mobility.

Referring to FIG. 3, the relationship between arsenic concentration of charge generation layer 3 and charge mobility is described. The thickness of charge generation layer 3 was 10 $\mu$m. Iodine was doped in charge generation layer 3 to give an in-film concentration of 4,000 ppm. The thickness of charge transport layer 2 was 30 $\mu$m. Iodine was doped in charge transport layer 2 to give an in-film concentration of 4,000 ppm. The charge mobility, $\mu$, was measured using the Time of Flight (T. O. F.) method.

Figure 2:
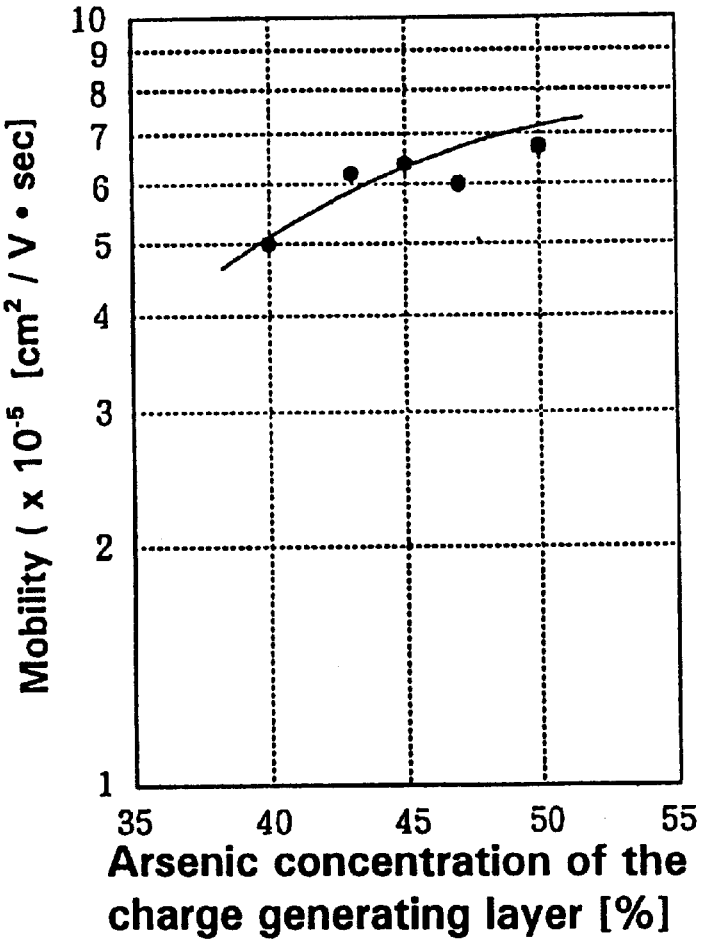
FIG. 2 is a graph showing a relationship between arsenic concentration in the charge generation layer and charge mobility.

The graph of FIG. 2 clearly shows that the charge mobility increases as the arsenic concentration of charge generation layer 3 increases above that of charge transport layer 2, which is held constant.

Relationship Between the Arsenic Concentration of the Charge Transport Layer and the Charge Mobility The relationship between the arsenic concentration of charge transport layer 2 and the charge mobility was determined for laminated photoconductors formed by using) a resistance heating deposition method to vacuum-deposit selenium-arsenic alloys on each of the cylindrical aluminum substrates. The arsenic concentration of charge transport layer 2 is varied, while the arsenic concentration of charge generation layer 3 was fixed at 40 wt. %.

Referring to FIG. 3), the relationship between arsenic concentration of charge transport layer 2 and charge mobility is described. The thickness of charge generation layer 3 was 10$\mu$m. Iodine was doped in charge generation layer 3 to give an in-film concentration of 4,000 ppm. In addition, the thickness of charge transport layer 2 was 30 $\mu$m. Iodine was doped in charge transport layer 2 to give an in-film concentration of 4,000 ppm. The charge mobility, $\mu$, was measured using the T. O. F. method as in the example of FIG. 2.

The graph of FIG. 3 clearly shows that the charge mobility increases as the arsenic concentration of charge transport layer 2 decreases below the arsenic concentration of charge generation layer 3, which is held constant.

Relationship Between the Arsenic Concentration of the Charge Generation Laver and the Charge Generation Efficiency The relationship between the arsenic concentration of charge generation layer 3 and the charge-generation efficiency was determined for laminated photoconductors formed by using a resistance heating deposition method to vacuum-deposit selenium-arsenic alloys on each of the cylindrical aluminum substrates. The arsenic concentration of charge generation layer 3 is varied, while the arsenic concentration of charge transport layer 2 was fixed at 30 wt. %.

Figure 4:
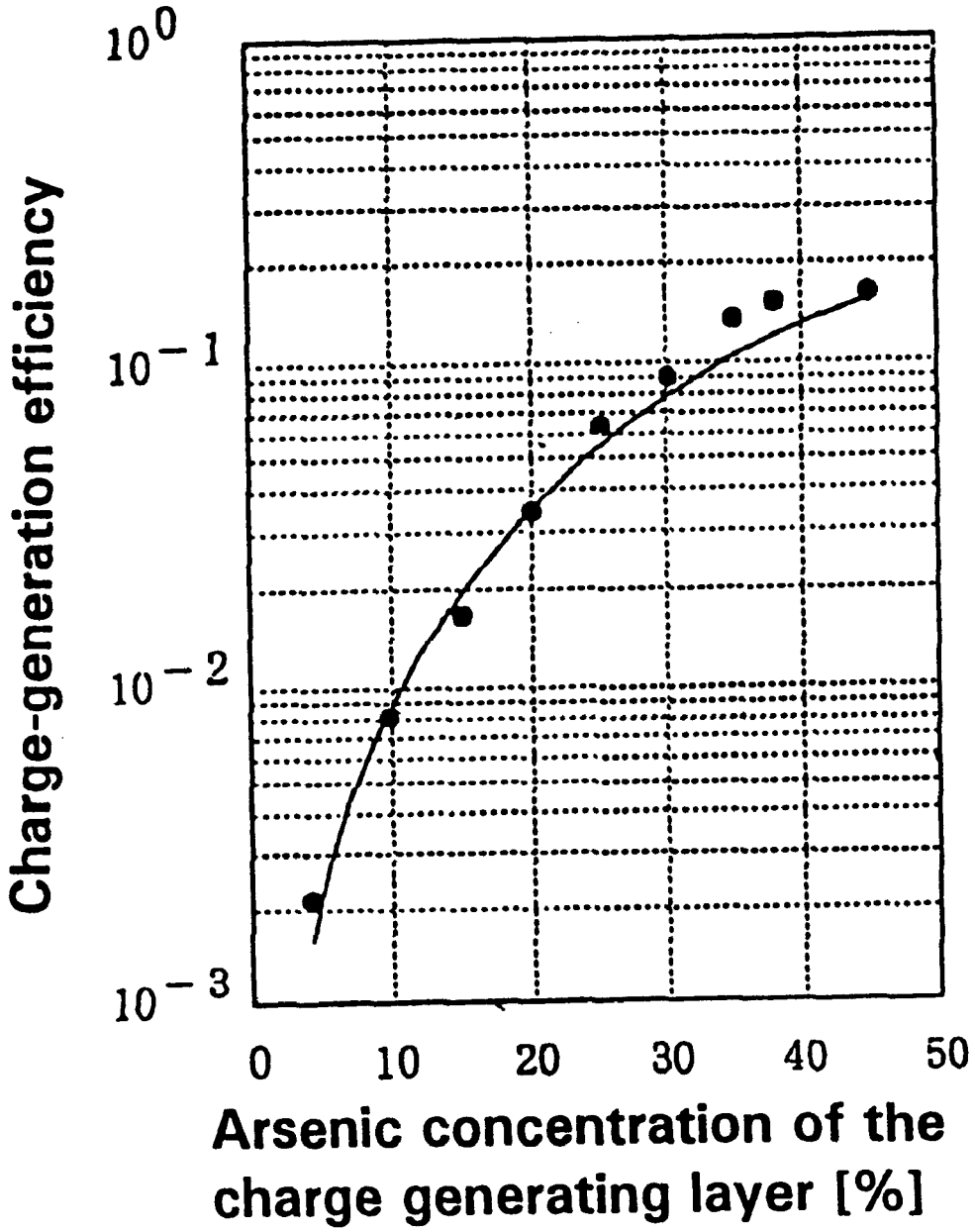
FIG. 4 is a graph showing relationship between arsenic concentration in the charge generation layer and charge-generation efficiency.

Referring to FIG. 4, the relationship between arsenic concentration of charge generation layer 3 and charge generation efficiency is described. The thickness of charge generation layer 3 was 10 $\mu$m. Iodine was doped in charge generation layer 3 to give an in-film concentration of 4,000 ppm. In addition, the thickness of charge transport layer 2 was 30 $\mu$m. Iodine was doped in charge transport layer 2 to give an in-film concentration of 4,000 ppm. The charge-generation efficiency was measured using the Xerographic Gain method.

The graph of FIG. 4 clearly shows that the charge-generation efficiency increases as the arsenic concentration of charge generation layer 3 increases when the arsenic concentration of charge transport layer 2 is held constant.

Relationship Between the Sensitivity and Combinations of Arsenic Concentrations of the Charge-Generation and Charge Transportation Layers The sensitivity was evaluated for varying combinations of arsenic concentrations of charge-generating layers 3 and charge transport layers 2 for laminated photoconductors form med by using the resistance heating deposition method to vacuum-deposit selenium-arsenic alloys on each of cylindrical aluminum substrates. The thickness of charge generation layer 3 was 10 $\mu$m. Iodine was doped in charge generation layer 3 to give an in-film concentration of 4,000 ppm. The thickness of charge transport layer 2 was 30 $\mu$m. Iodine was doped in charge transport layer 2 to give an in-film concentration of 4,000 ppm. The sensitivity was m measured based on the following criteria, using a photoconductor drum tester and the evaluation method of Electric Drum Analyzer (EDA):

⊕Sensitivity is less than 0.30 $\mu$J/cm$^2$ when the exposure wavelength $\lambda$=650 nm.

○: Sensitivity is 0.30 $\mu$J/cm$^2$ or more, but less than 0.35, $\mu$J/cm$^2$ when the exposure wavelength $\lambda$=650 nm.

Δ: Sensitivity is 0.35 $\mu$J/cm$^2$ or more, but less than 0.40 $\mu$J/cm$^2$ when the exposure wavelength $\lambda$=650 nm.

X: Sensitivity is 0.40 $\mu$J/cm$^2$ or more when the exposure wavelength $\lambda$=650 nm.

TABLE 1

| | Charge Transport Layer | | | | |
|---|---|---|---|---|---|
| | As = 20% | As = 25% | As = 30% | As = 35% | As = 40% |
| Charge generation Layer | | | | | |
| As = 30% | Δ | X | X | X | X |
| As = 35% | Δ | Δ | X | X | X |
| As = 40% | ⊕ | ○ | ○ | Δ | Δ |
| As = 45% | ⊕ | ⊕ | ○ | ○ | Δ |
| As = 50% | ⊕ | ⊕ | ⊕ | ○ | Δ |

For reference, Table 2 shows similar evaluation results when arsenic concentration was varied for single-layer ed selenium photoconductors formed by using the resistance heating deposition method to vacuum-deposit a selenium-arsenic alloy on each of the cylindrical aluminum substrates. The thickness of the photosensitive layer of the single-layer ed selenium photoconductor was 40 $\mu$m. Iodine was doped in the photosensitive layer layer to give an in-film concentration of 4,000 ppm.

TABLE 2

| Single Layered Selenium Photoconductor | | | | | | | |
|---|---|---|---|---|---|---|---|
| | As = | As = | As = | As = | As = | | |
| As <35% | 36% | 38% | 40% | 42% | 44% | As = 46% | As >50% |

The results in Tables 1 and 2 show that the sensitivity improves as the arsenic concentration of charge generation layer 3 exceeds that of charge transport layer 2.

Relationship Between the Wavelength of the Light Source and the Sensitivity

Figure 5:
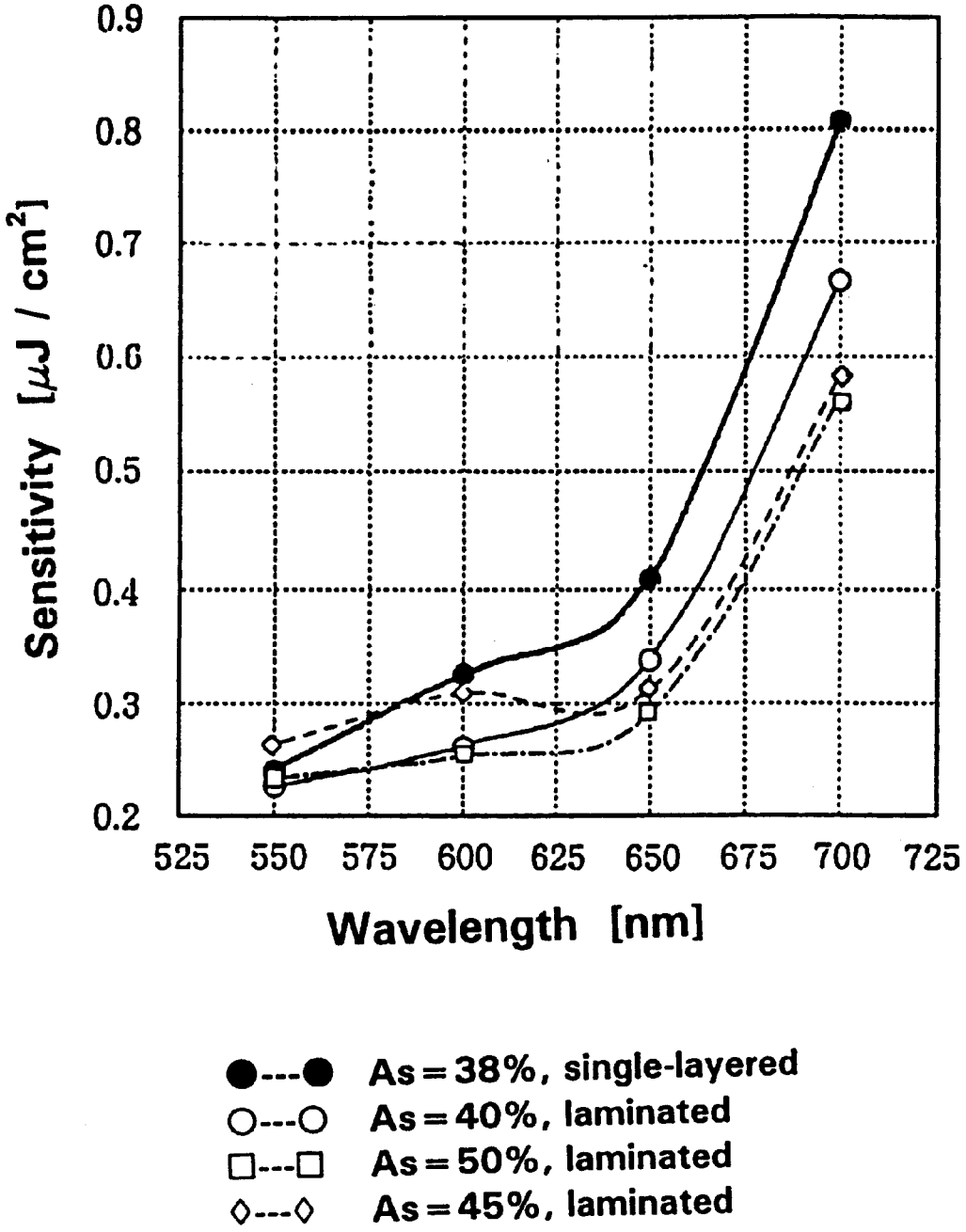
FIG. 5 is a graph showing relationship between the wavelength of the light source and the sensitivity observed when the arsenic concentration in the charge transport layer is fixed while the arsenic concentration of the charge generation layer is varied.

The relationship between the wavelength of the light source and the sensitivity was determined for the laminated photoconductors in which the arsenic concentration of charge generation layer 3 was varied (40%, 45%, and 50%), while the arsenic concentration of charge transport layer 2 was fixed at 30 wt.%. The same relationship was determined for the single-layer ed photoconductor with 38% arsenic concentration. FIG. 5 shows the results obtained.

Figure 6:
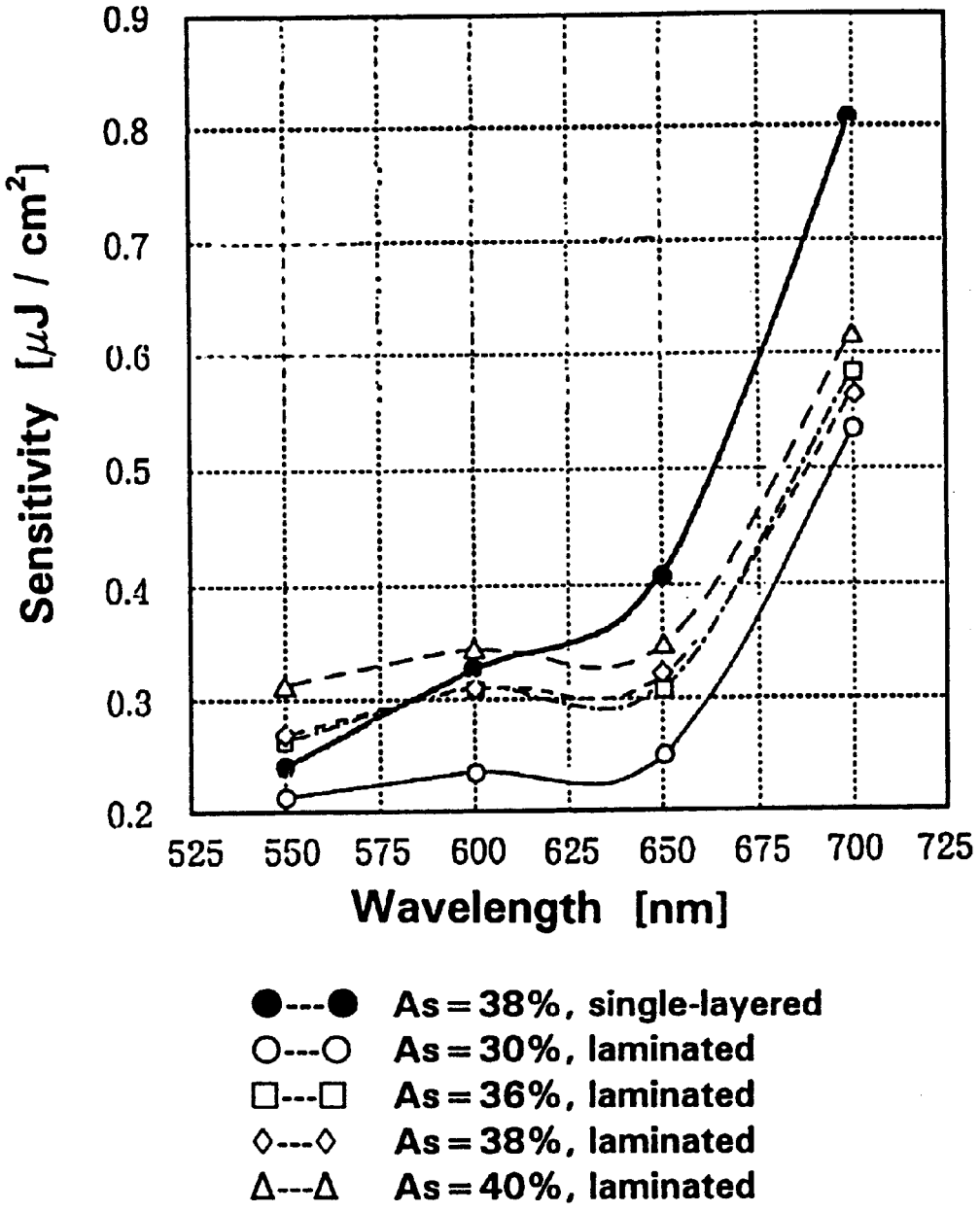
FIG. 6 is a graph showing relationship between the wavelength of the light source and the sensitivity observed when the arsenic concentration in the charge generation layer is fixed while the arsenic concentration of the charge transport layer is varied.

Likewise, the relationship between the wavelength of the light source and sensitivity was determined for the laminated photoconductors in which the arsenic concentration of charge transport layer 2 was varied (30%, 36%, 38%, and 40%), while the arsenic concentration of charge generation layer 3 was fixed at 40 wt.%. The same relationship was determined for the single-layered photoconductor with 38% arsenic concentration. FIG. 6 shows the results obtained. The sensitivity was measured in the same manner as described above.

Referring to FIGS. 5 and 6 when the wavelength of the light source is between 550 and 650 nm, the sensitivity of the laminated photoconductors, in contrast to the sensitivity of the single-layered photoconductor, does not depend on the wavelength of the light source.

The present invention improves the charge-generation efficiency and mobility. The resulting selenium photoconductor is capable of operating with large-scale and high-speed printers. In addition, the use of the laminated selenium photoconductor of the present invention enables the light source available for the photoconductor-mounting machine to be selected from a larger number of candidates. Consequently, the sensitivity is maintained at a more constant level irrespective of the variation of the wavelength of the light source.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic selenium photoconductor comprising:

a conductive substrate;

a charge transport layer on said conductive substrate;

a charge generation layer on said charge transport layer;

said charge generation layer having a first arsenic concentration;

said charge transport layer having a second arsenic concentration;

said charge generation layer and said charge transport layer are formed by vacuum-deposition of a selenium-arsenic alloy;

said first arsenic concentration being at least 20 weight percent greater than said second arsenic concentration;

said first arsenic concentration is between about 40 and 50 weight percent; and said second arsenic concentration is between about 20 and 30 weight percent.

2. An electrophotographic selenium photoconductor according to claim 1, further comprising a halogen doped into each of said charge generation layer and said charge transport layer at a concentration between about 500 and 10,000 ppm.

3. An electrophotographic selenium photoconductor according to claim 2, wherein said halogen is iodine.

4. An electrophotographic selenium photoconductor according to claim 1, wherein:

said charge generation layer has a thickness between about 5 and 20 $\mu$m; and said charge transport layer has a thickness between about 20 and 60 $\mu$m.

5. Photosensitive film for electrophotography, comprising:

charge transport layer;

a charge generation layer on said charge transport layer;

said charge generation layer having a first arsenic concentration;

said charge transport layer having a second arsenic concentration;

said charge generation layer and said charge transport layer are formed by vacuum-deposition of a selenium-arsenic alloy;

said first arsenic concentration is between about 40 and 50 weight percent;

said second arsenic concentration is between about 20 and 30 weight percent; and said first arsenic concentration being at least 20 weight percent greater than said second arsenic concentration, whereby a photo response is generated upon light impinging on a surface of said photosensitive film.

6. A photosensitive film for electrophotography according to claim 5, further comprising a halogen doped into each of said charge generation layer and said charge transport layer at a concentration between about 500 and 10,000 ppm.

7. A photosensitive film for electrophotography according to claim 7, wherein said halogen is iodine.

8. A photosensitive film for electrophotography according to claim 6, wherein:

said charge generation layer has a thickness between about 5 and 20 $\mu$m; and said charge transport layer has a thickness between about 20 and 60 $\mu$m.

* * * * *